US005442381A

United States Patent [19]

Fukubeppu et al.

[11] Patent Number: 5,442,381

[45] Date of Patent: Aug. 15, 1995

[54] THERMAL HEAD AND METHOD FOR DRIVING THE SAME

[75] Inventors: Koichi Fukubeppu; Takuji Hashiguchi; Tsuyoshi Yasutomi, all of Kokubu; Tetsuji Hyodo, Aira, all of Japan

[73] Assignee: Kyocera Corporation, Kyoto, Japan

[21] Appl. No.: 80,928

[22] Filed: Jun. 22, 1993

[30] Foreign Application Priority Data

Jun. 23, 1992 [JP] Japan ..... 4-164641
May 31, 1993 [JP] Japan ..... 5-129742

[51] Int. Cl.[6] ..... B41J 2/35
[52] U.S. Cl. ..... 347/18 L
[58] Field of Search ..... 346/76 PH; 347/13; 400/120

[56] References Cited

U.S. PATENT DOCUMENTS 4,203,136 3/1980 Wellendorf et al. .
4,575,732 3/1986 Kitaoka ..... 346/76 PH
4,788,587 10/1988 Bitoh et al. .

*Primary Examiner*—Huan H. Tran
*Attorney, Agent, or Firm*—Spensley Horn Jubas & Lubitz

[57] ABSTRACT

Disclosed is a thermal head comprising: plural heating elements, and a driving circuit element comprising plural switching elements connected individually to the heating elements, gate elements connected individually to the switching elements, and a shift register connected to the gate elements; wherein the plural heating elements are divided into plural blocks, and the gate elements of each block are connected to plural shift registers in the same number of bits as the number of heating elements of each block individually; strobe signals in the same number as the number of divisions of the block are fed into gate elements corresponding to each block; a clock gate element is provided in each block in order to obstruct clock input into the shift register corresponding to each block when printing of each block is active; and each block is further divided into plural small blocks, and the heating elements corresponding to each small block are disposed in every different block.

2 Claims, 13 Drawing Sheets

D11f
D11s
D12f
D12s
Fig. 2 (1) D1
Fig. 2 (2) CK1
Fig. 2 (3) XSB1
Fig. 2 (4) XSB2

| B1 | B2 | B3 | B4 | |
|---|---|---|---|---|
| PRINT | OFF | OFF | OFF | FIRST LINE |
| OFF | PRINT | OFF | OFF | |
| OFF | OFF | PRINT | OFF | |
| OFF | OFF | OFF | PRINT | |
| PRINT | OFF | OFF | OFF | SECOND LINE |
| OFF | PRINT | OFF | OFF | |
| OFF | OFF | PRINT | OFF | |
| OFF | OFF | OFF | PRINT | |
| PRINT | OFF | OFF | OFF | THIRD LINE |
| | | | | |

Fig. 6

| B1-1 | B2-1 | B1-2 | B2-2 | |
|---|---|---|---|---|
| PRINT | OFF | NO-PRINT | OFF | FIRST LINE |
| OFF | PRINT | OFF | NO-PRINT | |
| NO-PRINT | OFF | PRINT | OFF | |
| OFF | NO-PRINT | OFF | PRINT | |
| PRINT | OFF | NO-PRINT | OFF | SECOND LINE |
| OFF | PRINT | OFF | NO-PRINT | |
| NO-PRINT | OFF | PRINT | OFF | |
| OFF | NO-PRINT | OFF | PRINT | |
| PRINT | OFF | NO-PRINT | OFF | THIRD LINE |
| | | | | |

Fig. 7

| B1-1 | B2-1 | B1-2 | B2-2 | |
|---|---|---|---|---|
| PRINT | OFF | OFF | OFF | FIRST LINE |
| OFF | PRINT | OFF | OFF | |
| OFF | OFF | PRINT | OFF | |
| OFF | OFF | OFF | PRINT | |
| PRINT | OFF | OFF | OFF | SECOND LINE |
| OFF | PRINT | OFF | OFF | |
| OFF | OFF | PRINT | OFF | |
| OFF | OFF | OFF | PRINT | |
| PRINT | OFF | OFF | OFF | THIRD LINE |
| | | | | |

Fig. 9 (1) D
Fig. 9 (2) CK
Fig. 9 (3) LT
Fig. 9 (4) XSB1
Fig. 9 (5) XSB2
Fig. 9 (6) XSB3
Fig. 9 (7) XSB4
PRIOR ART

Fig. 10 (1) D
Fig. 10 (2) CK
Fig. 10 (3) XSB1
Fig. 10 (4) XSB2
Fig. 10 (5) XSB3
Fig. 10 (6) XSB4
PRIOR ART

Fig. 11 (1) D
Fig. 11 (2) CK
Fig. 11 (3) LT
Fig. 11 (4) XSB1
Fig. 11 (5) XSB2
Fig. 11 (6) XSB3
Fig. 11 (7) XSB4
T1
T1
T1
T1
PRIOR ART

Fig. 12 (1) D
Fig. 12 (2) CK
Fig. 12 (3) LT
Fig. 12 (4) XSB1
Fig. 12 (5) XSB2
Fig. 12 (6) XSB3
Fig. 12 (7) XSB4
T3
T2
T2
T2
T2
PRIOR ART

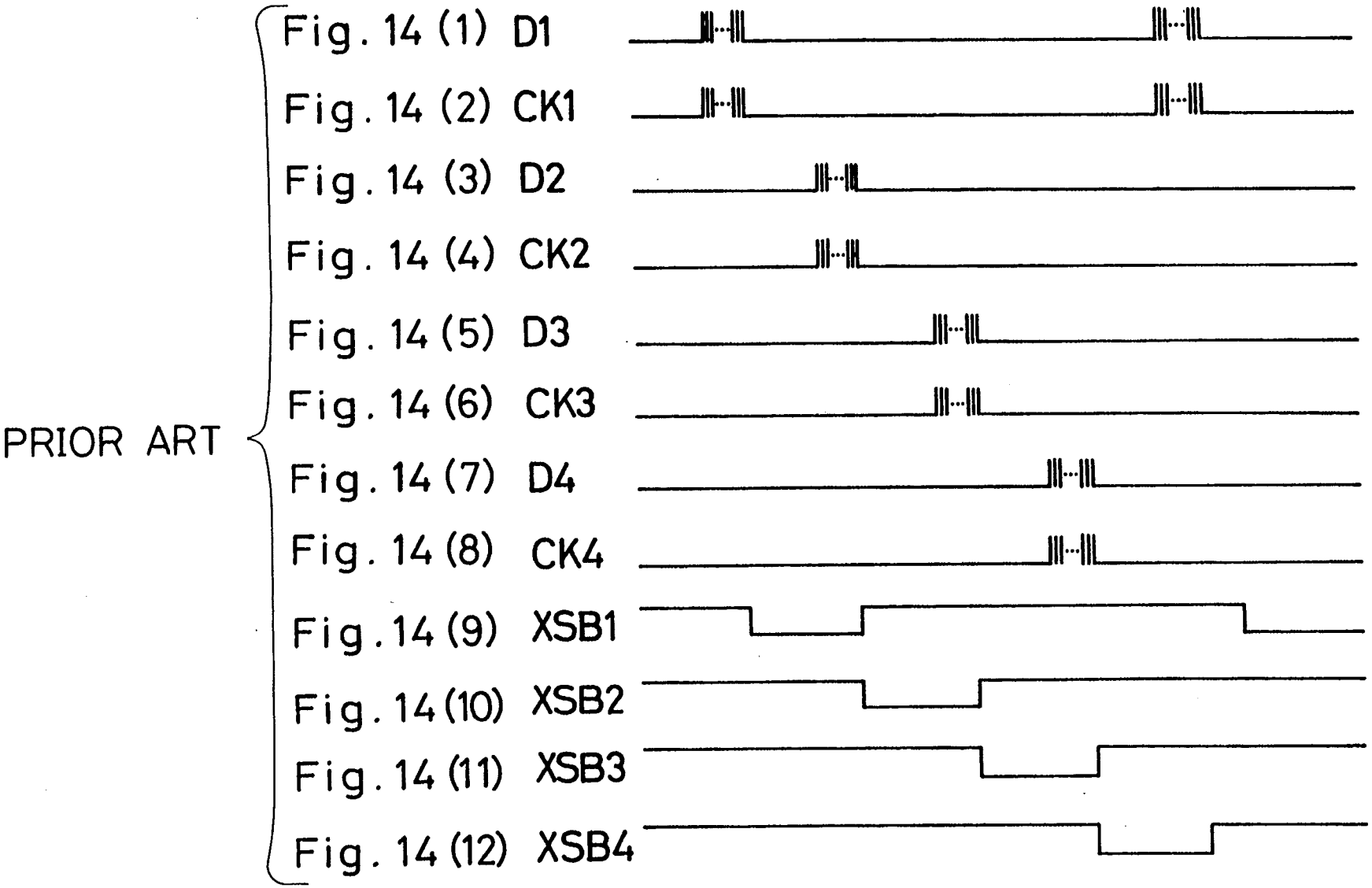
Fig. 14 (1) D1
Fig. 14 (2) CK1
Fig. 14 (3) D2
Fig. 14 (4) CK2
Fig. 14 (5) D3
Fig. 14 (6) CK3
Fig. 14 (7) D4
Fig. 14 (8) CK4
Fig. 14 (9) XSB1
Fig. 14 (10) XSB2
Fig. 14 (11) XSB3
Fig. 14 (12) XSB4
PRIOR ART

THERMAL HEAD AND METHOD FOR DRIVING THE SAME

BACKGROUND OF THE INVENTION

1. Field of the Invention

The present invention relates to a thermal head for feeding an electric current corresponding to a print signal to plural heating elements selectively to heat, and printing on a recording medium such as thermal sensitive paper and heat transfer film, preferably used in facsimile apparatus, image recording apparatus or the like, and a method for driving the same.

2. Description of the Related Art

FIG. 8 is a block diagram of a first example of a conventional thermal head 1. In the thermal head 1, heating resistive element 4 are connected to a common electrode 2, and switching elements 6 such as power transistors are individually connected to the other ends of the heating resistive element 4 through individual electrodes 5. The output terminals of the switching elements 6 are commonly connected to a grounding wire 7, and AND elements 8 are connected to the control signal input terminals of the switching elements 6. The switching elements 6 and AND elements 8 are formed in a driving circuit element 9 formed by integrated circuit technology, and also in the driving circuit element 9, a shift register 10 in the same number of bits as the number of all AND elements 8 and a latch circuit 11 are formed.

In this related art, assuming there are twenty-four heating resistive element 4, they are divided into four blocks B1 to B4 of six elements each in the sequence of array. Therefore, twenty-four pieces each are used for the switching elements 6 and AND elements 8, and strobe signals XSB1 to XSB4 are fed from a control device 13 to the AND elements 8 in every one of the blocks B1 to B4. The strobe signals XSB1 to XSB4 are low-active signals, and inverters 12 are provided in every one of strobe signals XSB1 to XSB4.

FIG. 9 is a timing chart for explaining the operation of the thermal head 1 in FIG. 8. In the shift register 10, print data D is fed as serial signals together with clock signal CK as shown in FIG. 9 (1) and FIG. 9 (2). At a predetermined timing, a latch signal LT in FIG. 9 (3) is fed into a latch circuit 11, and the data stored in the shift register 10 is latched. Afterwards, strobe signal XSB1 in FIG. 9 (4) is commonly fed to each AND element 8 of the first block B1.

Consequently, the print data D latched in the latch circuit 11 is sent out to the switching elements 6 of the first block B1. The switching elements 6 are set in the conductive or cut-off state depending on the print data, and in the conductive state the current from the common electrode 2 flows through the heating resistive element 4 into the grounding wire 7, and this heating resistive element 4 is heated and driven. In sequence, the corresponding strobe signals XSB2 to XSB4 are sequentially applied to the blocks B2 to B4, and the printing action continues.

While the strobe signal XSB4 is being produced, the print data D of the next line is sent out from the control device 13 together with the clock signal CK, and stored in the shift register 10. The storing timing of the print data D of the next line to the shift register 10 may be any period of output of the strobe signals XSB1 to XSB4 as far as after the output of the latch signal LT.

In the conventional thermal head 1 in FIG. 8, however, in the driving circuit element 9, the AND elements 8 are formed in the same number as the heating resistive elements 4, and the shift register 10 and latch circuit 11 require the same number of bits as the number of the heating resistive element 4, and therefore the constitution of the driving circuit element 9 is complicated, and the cost also increases.

Besides, as the constitution is complicated, the driving circuit element 9 becomes larger in size, and it is difficult to downsize the thermal head 1.

Moreover, since the print action period and data transfer period are set separately, the entire printing time becomes longer.

FIG. 10 is a timing chart showing the circuit action in the constitution, omitting the latch circuit 11 for simplifying the constitution in the thermal head 1 in FIG. 8, in which the data from the shift register 10 is fed in the corresponding AND elements 8 in every bit. In such structural example, since the latch circuit 11 is not present, in the period when the strobe signals XSB1 to XSB4 are sent to the data from the shift register 10, new print data cannot be stored in the shift register 10. Accordingly, As shown in FIG. 10 (1) to (6), after the print data D of one line portion is stored in the shift register 10 together with the clock signal CK, the strobe signals XSB1 to XSB4 are produced in time sequence, and after print action of one line is over, the print data of the next line is stored in the shift register 10.

In such conventional example, therefore, the print action time becomes longer.

FIG. 11 and FIG. 12 are timing charts showing other examples of the print action of the thermal head 1 in FIG. 8. In the thermal head 1, in order to heat the heating resistive element 4 to thermally record on a thermal sensitive recording paper or the like, when the thermal head 1 continues the printing action or when the environment of use is relatively high in temperature, the current passing time of the heating resistive element 4 per predetermined density is set shorter as compared with the case when beginning to use the thermal head 1 or when the environment of use is relatively low in temperature. That is, the thermal head 1 in FIG. 11 corresponds to the current passing time when relatively high in temperature, that is, to the pulse width T1 of the strobe signals XSB1 to XSB4, while FIG. 12 refers to the case in which the thermal head 1 is relatively low in temperature. That is, the pulse width T2 of the strobe signals XSB1 to XSB4 at low temperature is set longer than the pulse width T1 in FIG. 12.

Such pulse width is determined so that the total of the pulse widths of four strobe signals XSB1 to XSB4 may equal the print time of one line, or periodic interval T3 of latch signal LT when the thermal head 1 is at the predetermined lowest temperature as shown in FIG. 12, and the pulse width gradually decreases as the temperature of the thermal head 1 rises.

That is, in the thermal head 1 controlled by such control method, when the pulse width of the strobe signals XSB1 to XSB4 is maximum, it is necessary to control so as to store the print data of the next line until the output of the final strobe signal XSB4 is over in one line, and it is difficult to set the print period of the strobe signals XSB1 to XSB4 and the store period of print data in different time ranges as explained in FIG. 10.

FIG. 13 is a block diagram of a second example of a conventional thermal head la for solving the above problems. In this related art, the parts corresponding to those in the first conventional example are identified with same reference numerals. In this example, the latch circuit 11 is omitted in the constitution in FIG. 8, and four shift registers 10*a* to 10*d* are provided corresponding to four blocks B1 to B4 of the heating resistive element 4, print data D1 and clock signal CK1 are fed in the shift register 10*a* from a control device 13, and similarly thereafter, print data D4 and clock signal CK4 are fed in the shift register 10*d* from the control device 13.

The print action of this thermal head la is shown in the timing chart in FIG. 14. That is, as shown in FIG. 14 (1) and (2), the print data D1 is fed in the shift register 10*a* together with the clock signal CK1 from the control device 13. After storing of data is over, the strobe signal XSB1 in FIG. 14 (9) is sent out, and the heating resistive element 4 of the block B1 are selectively heated to make a print. During the output period of the strobe signal XSB1, the control device 13 feeds the print data D2 of the block B2 into the shift register 10*b* together with the clock signal CK2 as shown in FIG. 14 (3) and (4). Thereafter, similarly, during the print action of the block Bi (i=1 to 4), the print data of the next block Bi+1 is stored in the corresponding shift register 10. During the print action period of the block B4, the print data of the block B1 of the next line is stored in the shift register 10*a* as shown in FIG. 14 (1) and (2).

In such example, in the conventional thermal head without latch circuit 11, although the printing speed is improved as compared with the case of printing action explained in FIG. 10, it is necessary to divide all heating resistive element 4 into four blocks, dispose shift registers 10*a* to 10*d* in each block, and feed print data and clock signal individually in each shift register 10*a* to 10*d*, Accordingly, the number of input and output terminals in the control device 13 and driving circuit element 9 increases, and the connection wirings for connecting these input and output terminals increase in number, so that the constitution of the thermal head la is complicated.

SUMMARY OF THE INVENTION

To solve the above problems, it is hence a primary object of the invention to provide a thermal head capable of simplifying the circuit composition and reducing the circuit scale, by omitting the conventional latch circuit.

It is another object of the invention to provide a thermal head capable of obtaining a recorded image of high quality with less fluctuation of printing density, by dividing plural heating resistive element and driving circuits into plural blocks, and printing each block by time division, thereby avoiding influence of voltage drop in the common wiring.

It is yet another object of the invention to provide a thermal head capable of increasing the printing speed by transferring data in other block while printing in a certain block at the same time.

It is a further object of the invention to provide a method for driving a thermal head capable of arbitrarily changing the number of times or pattern of time division driving, by controlling the generation timing of clock pulse without increasing the number of strobe signal lines for determining the driving timing of each block.

To achieve the above objects, the invention provides a thermal head comprising:

plural heating elements, and a driving circuit element comprising plural switching elements connected individually to the heating elements, gate elements connected individually to the switching elements, and a shift register connected to the gate elements, wherein the plural heating elements are divided into plural blocks, and the gate elements of each block are connected to plural shift registers in the same number of bits as the number of heating elements of each block individually, strobe signals in the same number as the number of divisions of the block are fed into gate elements corresponding to each block, a clock gate element is provided in each block in order to obstruct clock input into the shift register corresponding to each block when printing of each block is active, and each block is further divided into plural small blocks, and the heating elements corresponding to each small block are disposed in every different block.

The invention also provides a method for driving a thermal head which comprises:

plural heating elements, and a driving circuit element comprising plural switching elements connected individually to the heating elements, gate elements connected individually to the switching elements, and a shift register connected to the gate elements, wherein the plural heating elements are divided into plural blocks, and the gate elements of each block are connected to plural shift registers in the same number of bits as the number of heating elements of each block individually, strobe signals in the same number as the number of divisions of the block are fed into gate elements corresponding to each block, a clock gate element is provided in each block in order to obstruct clock input into the shift register corresponding to each block when printing of each block is active, and each block is further divided into plural small blocks, and the heating elements corresponding to each small block are disposed in every different block, the method comprising the steps of:

feeding print data of one line portion continuously into each shift register, generating a clock in the period where the print data corresponding to each small block and print data to be of no printing are fed, and storing the print data corresponding to each small block into a predetermined shift register.

According to the invention, plural heating elements are divided into plural blocks, shift registers are also divided corresponding to the blocks, and strobe signals in the same number as the number of divisions of the blocks are fed into the gate elements corresponding to each block, thereby driving in time division in each block.

Therefore, the print density fluctuations may be restrained by lessening the effects of voltage drop in the common electrode to which the heating elements are commonly connected.

Furthermore, when printing of each block is active, clock gate elements for obstructing clock input into shift registers corresponding to a certain block are provided in each block, and therefore the hitherto indispensable latch circuit can be omitted, and it is also possible to transfer data of other block during the printing action period of a certain block.

In the driving method of the invention, print data of one line portion is continuously fed into each shift register, and a clock is generated in the period where print data corresponding to each small block and print data to be of no printing are fed, and the print data corresponding to each small block is stored in the predetermined shift register, so that it is possible to drive in time division in the number of times corresponding to the number of small blocks in one block without increasing the number of strobe lines for controlling the timing of each block. Therefore, it is possible to set the number of time divisions more minutely than the number of strobe lines, so that the printing density fluctuations may be compensated more precisely.

BRIEF DESCRIPTION OF THE DRAWINGS

Other and further objects, features, and advantages of the invention will be more explicit from the following detailed description taken with reference to the drawings wherein:

FIGS. 4(1)–4(4) are timing charts showing still another example of operation of the thermal head 21 in FIG. 1.

FIG. 6 is a schematic diagram showing a printing region on a recording medium in the embodiment shown in FIG. 1.

FIG. 7 is a schematic diagram showing a printing region on a recording medium when printed in the operation timing shown in FIG. 3.

FIGS. 14(1)–14(12) are timing charts showing the operation of the thermal head la in FIG. 13.

DETAILED DESCRIPTION OF THE PREFERRED EMBODIMENTS

Figure 1:
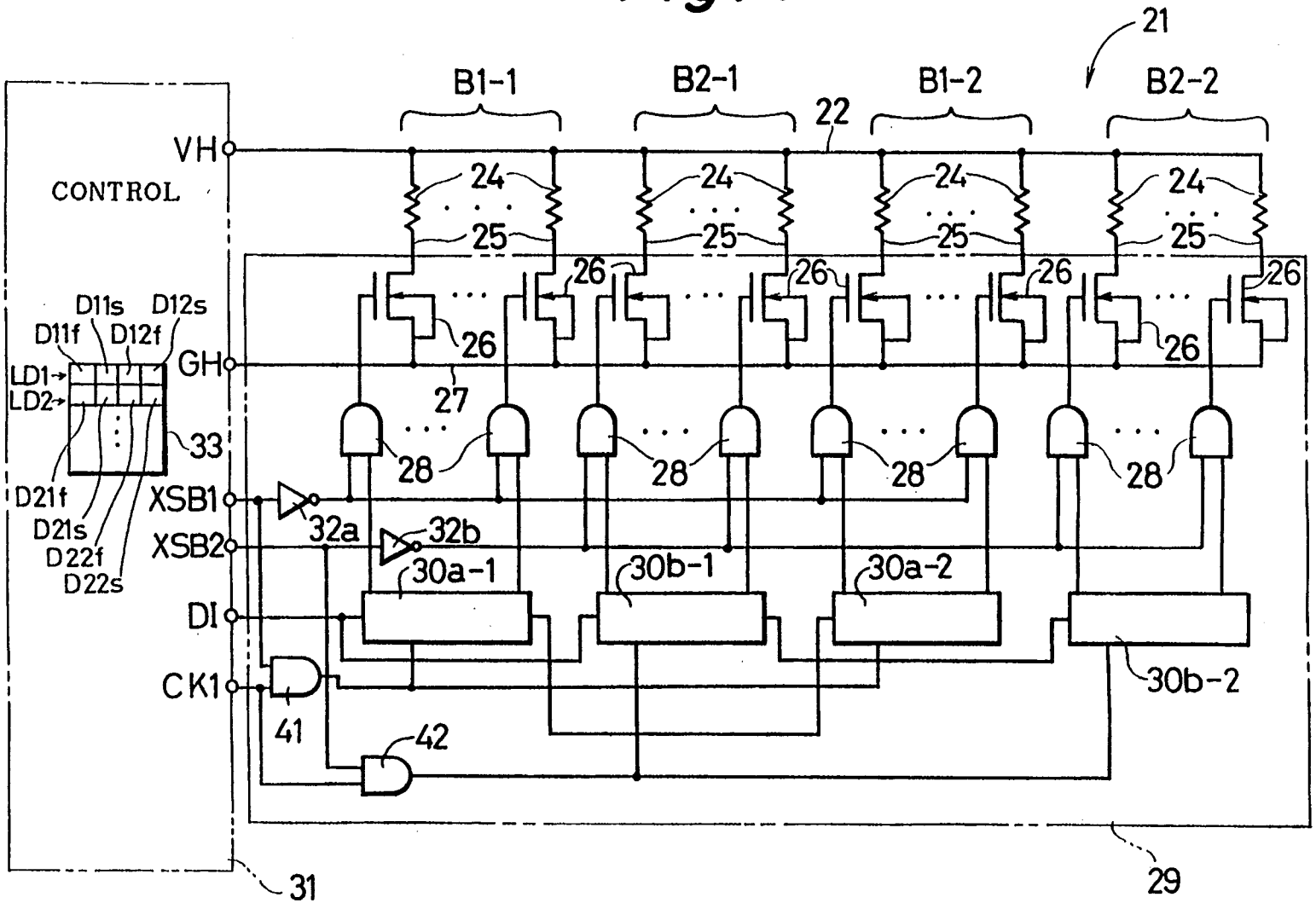
FIG. 1 is a block diagram of a thermal head 21 in an embodiment of the invention.

Now referring to the drawing, preferred embodiments of the invention are described below.

FIG. 1 is a block diagram showing an electric constitution of a thermal head 21 in an embodiment of the invention. In this thermal head 21, one end of each heating resistive element 24 is connected commonly to a common electrode 22, and the other end of each heating resistive element 24 is individually connected to a switching element 26 such as power transistor through an individual electrode 25. The output terminal of each switching element 26 is commonly connected to a grounding wire 27, and an AND element 28 as a gate element is connected to the control signal input terminal of each switching element 26.

The heating resistive element 24, switching elements 26 and AND elements 28 are first roughly divided into two major blocks, that is, block B1 consisting of small blocks B1-1 and B1-2, and block B2 consisting of small blocks B2-1 and B2-2, and are further divided into a total of four small blocks B1-1, B2-1, B1-2 and B2-2, and the AND element 28 of small block B1-1 is connected to a shift register 30*a*-1, the AND element 28 of small block B2-1 to a shift register 30*b*-1, the AND element 28 of small block B1-2 to a shift register 30*a*-2, and the AND element 28 of small block B2-2 to a shift register 30*b*-2. The shift registers 30*a*-1, 30*a*-2, 30*b*-1 and 30*b*-2 are mutually connected so that the print signal D1 may be first transferred into the shift register 30*a*-1 and then fed into the shift register 30*a*-2, and that the same print data D1 may be transferred into the shift register 30*b*-1 and then fed into the shift register 30*b*-2.

It is wired so that strobe signal XSB1 for determining the driving timing of heating resistive element 24 of small block B1-1 and heating resistive element 24 of small block B1-2 may be fed into the AND element 28 of small block B1-1 and AND element 28 of small block B1-2 through an inverter 32*a*. It is also wired so that strobe signal XSB2 for determining the driving timing of the heating resistive element 24 of small block B2-1 and heating resistive element 24 of small block B2-2 may be fed into the AND element 28 of small block B2-1 and AND element 28 of small block B2-2 through an inverter 32*b*.

Clock signal CK1 for determining the transfer timing of print signal D1 is fed into AND elements 41 and 42, the logical product of the strobe signal XSB1 and clock signal CK1 is fed into shift registers 30*a*-1 and 30*a*-2, while the logical product of the strobe signal XSB2 and clock signal CK1 is fed into shift registers 30*b*-1 and 30*b*-2. The switching elements 26, AND elements 28, shift registers 30*a*-1, 30*b*-1, 30*a*-2 and 30*b*-2, and others are formed in a driving circuit element 29 by integrated circuit technology.

A memory 33 is provided in a control device 31 for controlling the thermal head 21, and print data in every line is stored in this memory 33. For example, the first line print data LD1 possesses four divided data D11*f*, D11*s*, D12*f* and D12*s*, the second line print data LD2 possesses four divided data D21*f*, D21*s*, D22*f* and D22*s*, and thereafter the print data denoted with similar numerals are stored in the memory 33.

Figure 2:
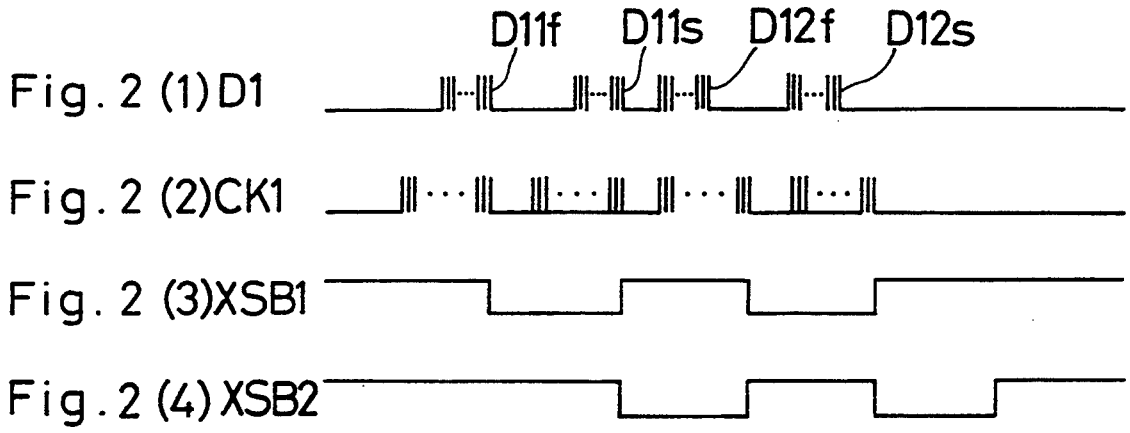
FIGS. 2(1)–2(4) are timing charts showing an example of operation of the thermal head 21 in FIG. 1.

FIG. 2 is a timing chart showing an example of operation of the thermal head 21 in FIG. 1. First, as shown in FIG. 2 (1), from the control device 31, no-print data (low level in FIG. 2) and first half data D11*f* are delivered to the driving circuit element 29 together with clock signal CK1 in FIG. 2 (2). At this time, the strobe signals XSB1 and XSB2 are both at high level. Therefore, the clock signal CK1 is fed into the shift registers 30*a*-1, 30*a*-2 and 30*b*-1 and 30*b*-2 through AND elements 41 and 42, and no-print data is transferred and stored in the shift registers 30*a*-2 and 30*b*-2, and first half data D11*f* in the shift registers 30*a*-1 and 30*b*-1, by the clock pulse in the number of pixels of each block.

When the strobe signal XSB1 becomes low level, the first half data D11*f* from the shift register 30*a*-1 and no-print data from the shift register 30*a*-2 are issued to the heating resistive element 24 of small blocks B1-1 and B1-2 through the AND element 28 and switching element 26, respectively, and the heating resistive element 24 of the small block B1-1 are selectively heated and driven, thereby printing thermosensitively. On the other hand, the strobe signal XSB2 becomes high level, and the clock signal CK1 is fed into shift registers 30*b*-1 and 30*b*-2 through the AND element 42, and the no-print data is transferred and stored in the shift register 30*b*-2 and the second half data D11*s* in the shift register 30*b*-1, by the clock pulse in the number of pixels of each block. At this time, the strobe signal XSB1 is at low level, and the AND element 41 prevents clock input into the shift registers 30*a*-1 and 30*a*-2.

Consequently, when the strobe signal XSB2 becomes low level, the second half data D11*s* from the shift register 30*b*-1 and no-print data from the shift register 30*b*-2 are issued to the heating resistive element 24 of small blocks B2-1 and B2-2 through the AND element 28, respectively, and the heating resistive element 24 in the small block B2-1 are selectively heated and driven, thereby printing thermosensitively. On the other hand, the strobe signal XSB1 becomes high level, and the clock signal CK1 is fed into the shift registers 30*a*-1 and 30*a*-2 through the AND element 41, and the first half data D12*f* is transferred and stored in the shift register 30*a*-2 and no-print data in the shift register 30*a*-1, respectively, by the clock pulse in the number of pixels of each block. At this time, since the strobe signal XSB2 is at low level, the AND element 42 prevents clock input into the shift registers 30*b*-1 and 30*b*-2.

Next, when the strobe signal XSB1 becomes low level, the no-print data from the shift register 30*a*-1 and first half data D12*f* from the shift register 30*a*-2 are issued to the heating resistive element 24 of the small blocks B1-1 and B1-2 through the AND element 28 and switching element 26, respectively, and the heating resistive element 24 in the small block B1-2 are selectively heated and driven, thereby printing thermosensitively. On the other hand, the strobe signal XSB2 becomes high level, and the clock signal CK1 is fed to the shift registers 30*b*-1 and 30*b*-2 through the AND element 42, and no-print data is transferred and stored in the shift register 30*b*-2 and second half data D12*s* in the shift register 30*b*-1, respectively, by the clock pulse in the number of pixels of each block. At this time, since the strobe signal XSB1 is at low level, the AND element 41 prevents clock input into the shift registers 30*a*-1 and 30*a*-2.

When the strobe signal XSB2 becomes low level, the no-print data from the shift register 30*b*-1 and second half data D12*s* from the shift register 30*b*-2 are issued to the heating resistive element 24 of the small blocks B2-1 and B2-2 through the AND element 28 and switching element 26, respectively, and the heating resistive element 24 of the small block B2-2 are selectively heated and driven, thereby printing thermosensitively. Thus, printing of print data of the first line is over.

On the other hand, the strobe signal XSB1 becomes high level, and the clock signal CK1 is fed into the shift registers 30*a*-1 and 30*a*-2 through the AND element 41, and the no-print data is transferred and stored in the shift register 30*a*-2 and first half data D21*f* of the second line in the shift register 30*a*-1, respectively, by the clock pulse in the number of pixels of each block.

Consequently, the print data after the second line are, repeating the same operation, transferred and stored in the shift registers 30*a*-1, 30*a*-2, 30*b*-1 and 30*b*-2, and the heating resistive element 24 are selectively heated and driven in the sequence of small blocks B1-1, B2-1, B1-2 and B2-2, by changeover of the strobe signals XSB1 and XSB2, thereby printing thermosensitively.

Thus, in the embodiment, the latch circuit as used in the prior art is not used in the thermal head 21, and the printing region of each small block is continuously formed, so that the same printing quality as in the prior art is obtained.

Figure 3:
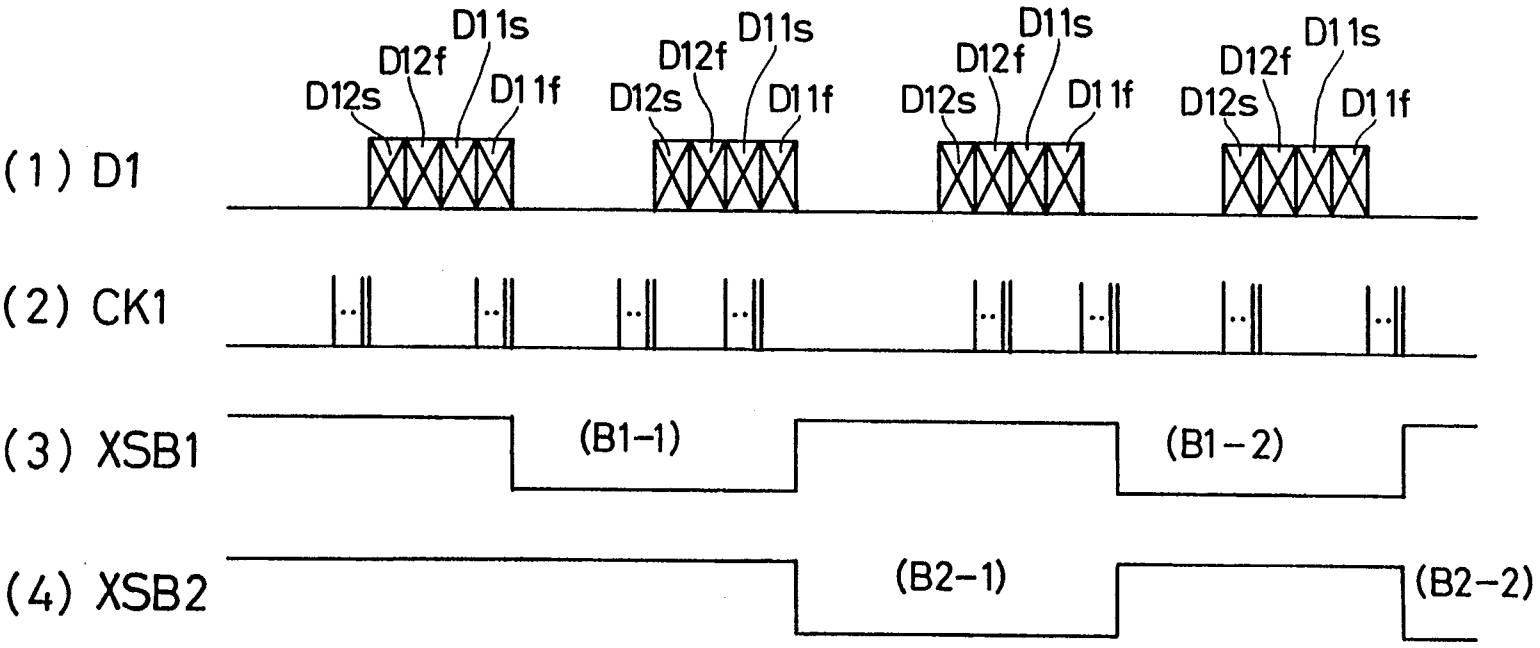
FIGS. 3(1)–3(4) are timing charts showing another example of operation of the thermal head 21 in FIG. 1.

FIG. 3 is a timing chart showing another example of operation of the thermal head 21 in FIG. 1. First of all, in the low level state of the print signal D1, when the clock signal CK1 issues pulses of one small block portion, data of all low level is transferred to the shift registers 30*a*-1 and 30*b*-1.

Next, as print signal D1, data D12*s*, D12*f*, D11*s* and D11*f* of one line portion are continuously sent out, and only in the period of transmission of data D11*f* of small block B1-1, when the clock signal CK1 generates pulses of one small block portion, data D11*f* is transferred to the shift registers 30*a*-1 and 30*b*-1, and data of low level stored in the shift registers 30*a*-1 and 30*b*-1 are transferred to the shift registers 30*a*-2 and 30*b*-2.

Next, when the strobe signal XSB1 is changed from high level to low level, high level is fed to the AND elements 28 of small blocks B1-1 and B1-2, so that the small blocks B1-1 and B1-2 are ready to print, and a current selectively flows into the heating resistive element 24 of the small block B1-1 according to the data D11*f* stored in the shift register 30*a*-1, thereby printing, Besides, since data of all low level are stored in the shift register 30*a*-2, the small block B1-2 is not printed substantially. Thus, the small block B1-1 can print data D11*f*.

In the period when the strobe signal XSB1 is at low level, the AND element 41 always issues a low level, and therefore input of the clock signal CK1 into the shift registers 30*a*-1 and 30*a*-2 is prevented. Hence, the data is not changed even if the small blocks B1-1 and B1-2 are in printing ready state. In this period, with the print signal D1 in low level state, when the clock signal CK1 generates pulses of one small block portion, the clock signal CK1 is fed in the shift registers 30*b*-1 and 30*b*-2, and data of all low level are transferred. Next, as print signal D1, data D12*s*, D12*f*, D11*s* and D11*f* of one line portion are continuously sent out, but only in the period of transmission of data D11*s* of small block B2-1, when the clock signal CK1 generates pulses of one small clock portion, data D11*s* is transferred to the shift register 30*b*-1, while the data of low level stored in the shift register 30*b*-1 is transferred to the shift register 30*b*-2.

Next, when the strobe signal XSB1 returns to high level and strobe signal XSB2 is inverted to low level, high level is fed to the AND element 28 of small blocks B2-1 and B2-2, and the small blocks B2-1 and B2-2 become ready to print, and a current selectively flows into the heating resistive element 24 of the small block B2-1 according to the data D11*s* stored in the shift register 30*b*-1, thereby printing. Since data of all low level are stored in the shift register 30*b*-2, the small block B2-2 is not printed substantially. In this way, the small block B2-1 prints the data D11*s*.

Incidentally, while the strobe signal XSB2 is at low level, the AND element 42 always issues a low level, and input of clock signal CK1 into the shift registers 30*b*-1 and 30*b*-2 is prevented. Therefore, the data is not changed if the small blocks B2-1 and B2-2 are in printing ready state. In this period, as the print data D12*s*, D12*f*, D11*s* and D11*f* of one line portion are continuously sent out, but only in the period of transmission of data D12*f* of small block B1-2, when the clock signal CK1 generates pulses of one small block portion, the data D12*f* is transferred to the shift register 30*a*-1.

Next, with the print signal D1 in low level state, when the clock signal CK1 generates pulses of one small block portion, data of all low level are transferred into the shift register 30*a*-1, and the data stored in the shift register 30*a*-1 is transferred to the shift register 30*a*-2.

Next, when the strobe signal XSB2 returns to high level and strobe signal XSB1 is inverted to low level, a high level is fed to the AND elements 28 of the small blocks B1-1 and B1-2, and the small blocks B1-1 and B1-2 are in printing ready state, and a current selectively flows into the heating resistive element 24 of the small block B1-2 according to the data D12*f* stored in the shift register 30*a*-2, thereby printing. Besides, since the data of all low level are stored in the shift register 30*a*-1, the small block B1-1 is not printed substantially. Thus, the small block B1-2 can print the data D12*f*.

In the low level period of strobe signal XSB1, input of clock signal CK1 into the shift registers 30*a*-1 and 30*a*-2 is prevented. In this period, as the print signal D1, data D12*s*, D12*f*, D11*s* and D11*f* of one line portion are continuously sent out, but only in the period of transmission of data D12*s* of small block B2-2, when the clock signal CK1 generates pulses of one small block portion, data D12*s* is transferred to the shift register 30*b*-1.

Consequently, in the low level state of the print signal D1, when the clock signal CK1 generates pulses of one small block portion, data of all low level are transferred to the shift register 30*b*-1, while the data D12*s* stored in the shift register 30*b*-1 is transferred to the shift register 30*b*-2.

When the strobe signal XSB1 returns to high level and the strobe signal XSB2 is inverted to low level, a high level is fed to the AND elements 28 of the small blocks B2-1 and B2-2, and the small blocks B2-1 and B2-2 are in printing ready state, and according to the data D12*s* stored in the shift register 30*b*-2, a current selectively flows into the heating resistive element 24 of the small block B2-2, thereby printing. Since data of all low level is stored in the shift register 30*b*-1, the small block B2-1 is not printed substantially. Thus, the small block B2-2 prints the data D12*s*.

In this way, the print data LD1 of the first line can be printed by dividing in time into four periods in every one of four small blocks B1-1, B2-1, B1-2 and B2-2. The print data LD2 of the second line and subsequent lines can be also printed by similar time division driving as in the first line.

FIG. 4 is a timing chart showing still another example of operation of the thermal head 21 in FIG. 1. First, as the print data D1, data D12*s*, D12*f*, D11*s* and D11*f* of one line portion are continuously sent out, and only in the period of transmission of data D12*f* of the small block B1-2 and the period of transmission of data D11*f* of the small block B1-1, when the clock signal CK1 generates pulses of one small block portion, the data D12*f* is transferred to the shift register 30*a*-2, and the data D11*f* is transferred to the shift register 30*a*-1. In this period, since the strobe signal XSB2 is at low level, any data is not transferred to the shift registers 30*b*-1 and 30*b*-2.

When the strobe signal XSB1 is inverted from high level to low level, and the strobe signal XSB2 returns to high level, the small blocks B1-1 and B1-2 are in printing ready state, and the small block B1-1 prints according to the data D11*f* stored in the shift register 30*a*-1, while the small block B1-2 prints according to the data D12*f* stored in the shift register 30*a*-2.

In the low level period of strobe signal XSB1, input of clock signal CK1 into the shift registers 30*a*-1 and 30*a*-2 is prevented, and therefore the data is not changed even if the small blocks B1-1 and B1-2 are in printing ready state. In this period, as the print signal D1, data D12*s*, D12*f*, D11*s* and D11*f* of one line portion are continuously sent out, and only in the period of transmission of data D12*s* of the small block B2-2 and in the period of transmission of data D11*s* of the small block B2-1, the clock signal CK1 generates pulses of one small block portion, and the data D12*s* is transferred to the shift register 30*b*-2, so that the data D11*s* is transferred to the shift register 30*b*-1. In this period, since the strobe signal XSB1 is at low level, any data is not transferred to shift registers 30*a*-1 and 30*a*-2.

Next, when the strobe signal XSB1 returns to high level and the strobe signal XSB2 is inverted to low level, the small blocks B2-1 and B2-2 are in printing ready state, and the small block B2-1 prints according to the data D11*s* stored in the shift register 30*b*-1, and the small block B2-2 prints according to the data D12*s* stored in the shift register 30*b*-2. While the strobe signal XSB2 is at low level, input of clock signal CK1 into shift registers 30*b*-1 and 30*b*-2 is prevented, and therefore the data is not changed even if the small blocks B2-1 and B2-2 are in printing ready state.

Thus, the data of one line portion can be printed in time division in two periods, in every one of four small blocks B1-1, B2-1, B1-2 and B2-2.

Figure 5:
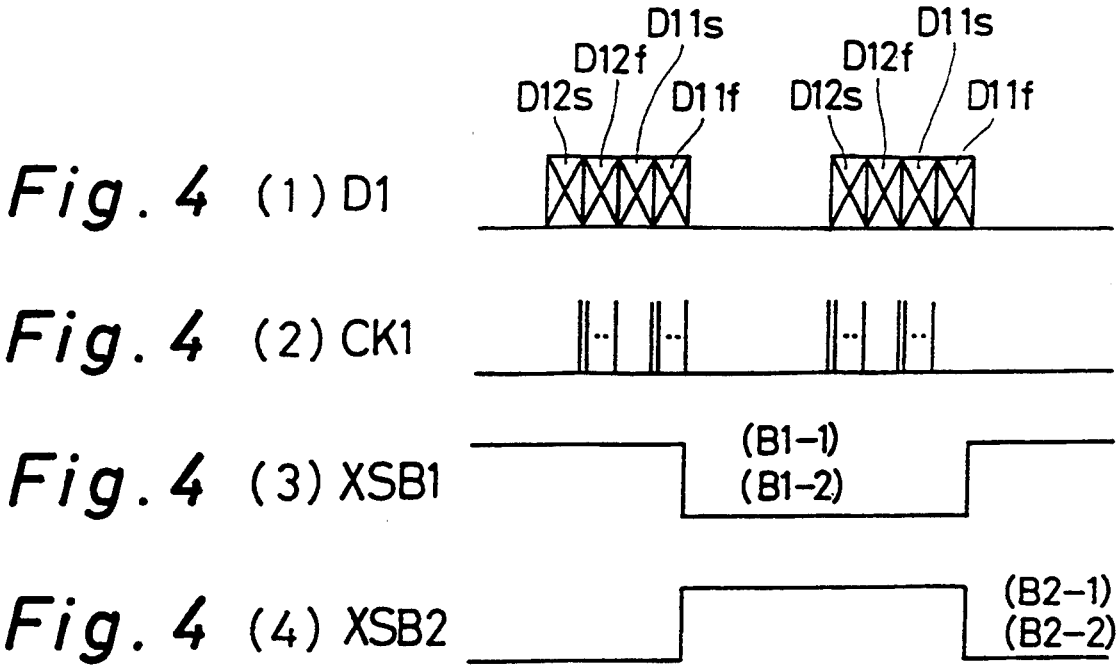
FIG. 5 is a schematic diagram showing a printing region on a recording medium in first conventional example and second conventional example.
Figure 8:
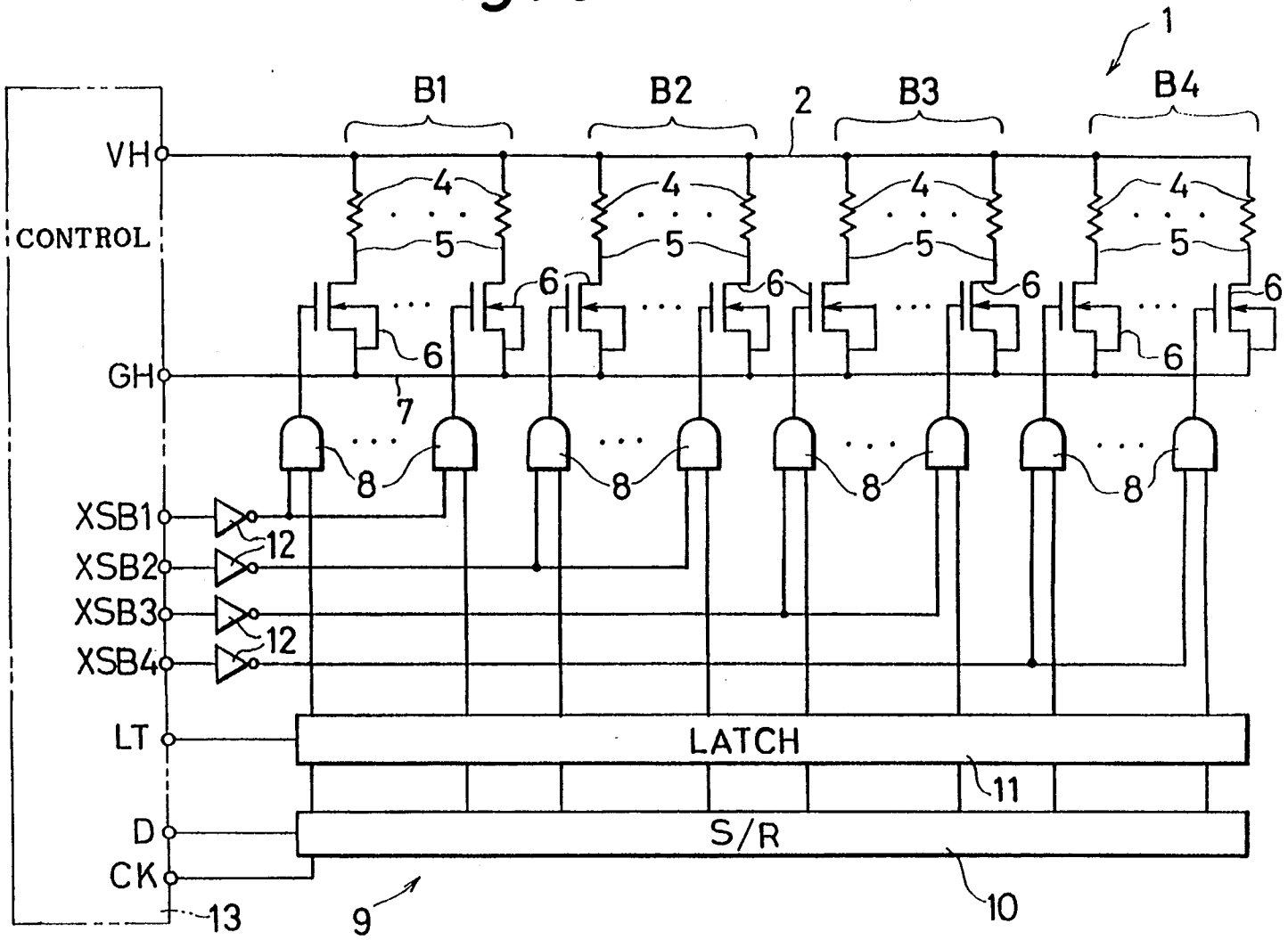
Fig. 8 PRIOR ART
FIG. 8 is an electric circuit diagram of a thermal head 1 in the first conventional example.
Figure 9:
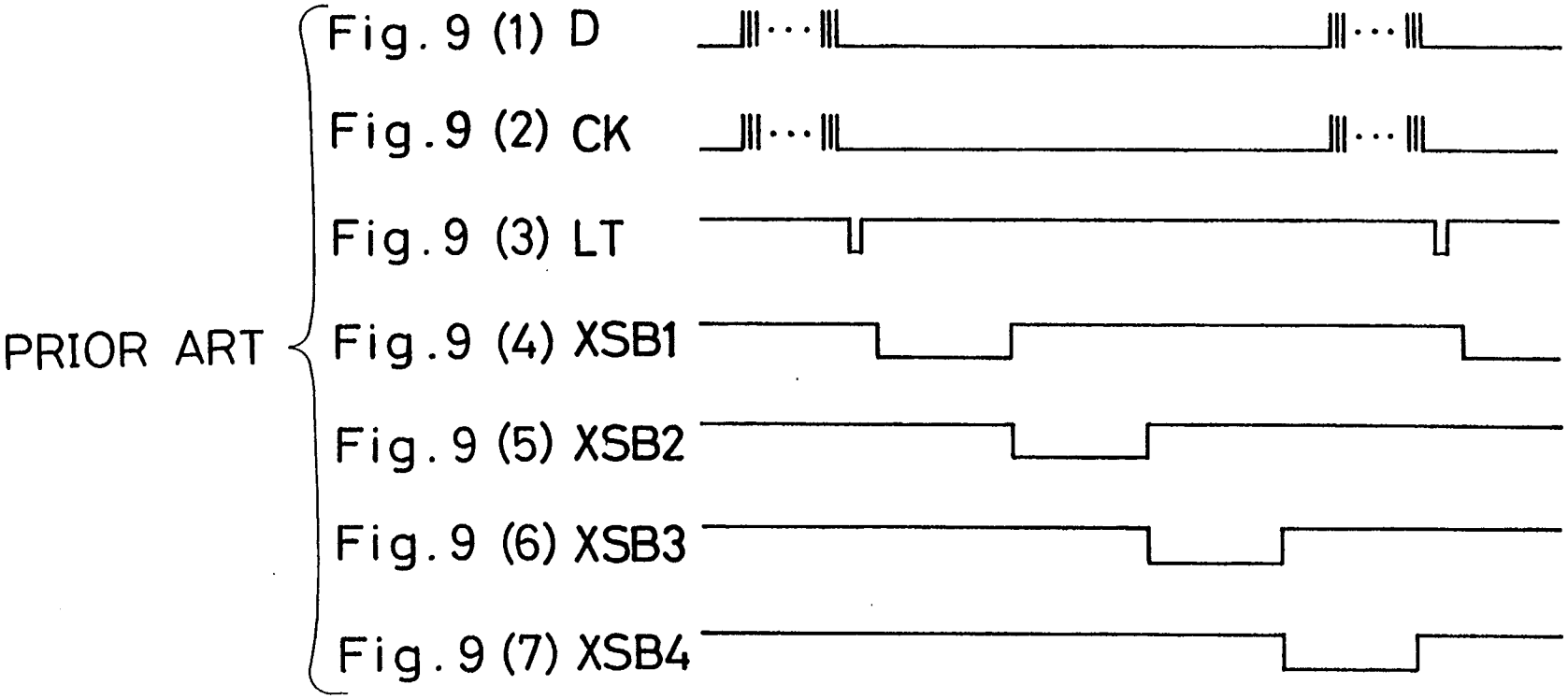
FIGS. 9(1)–9(7) are timing charts showing an operation example of the thermal head 1 in FIG. 8.
Figure 10:
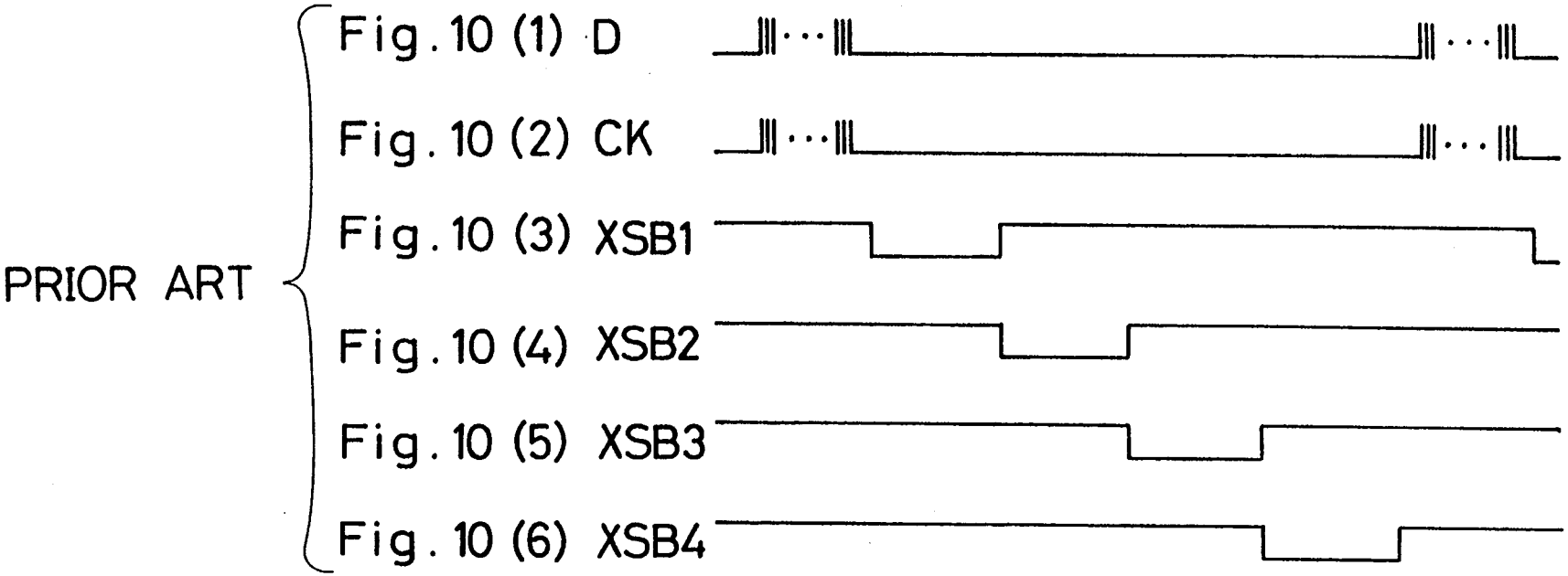
FIGS. 10(1)–10(6) are timing charts showing an operation example in the case of removing a latch circuit 11 from the thermal head 1 in FIG. 8.
Figure 11:
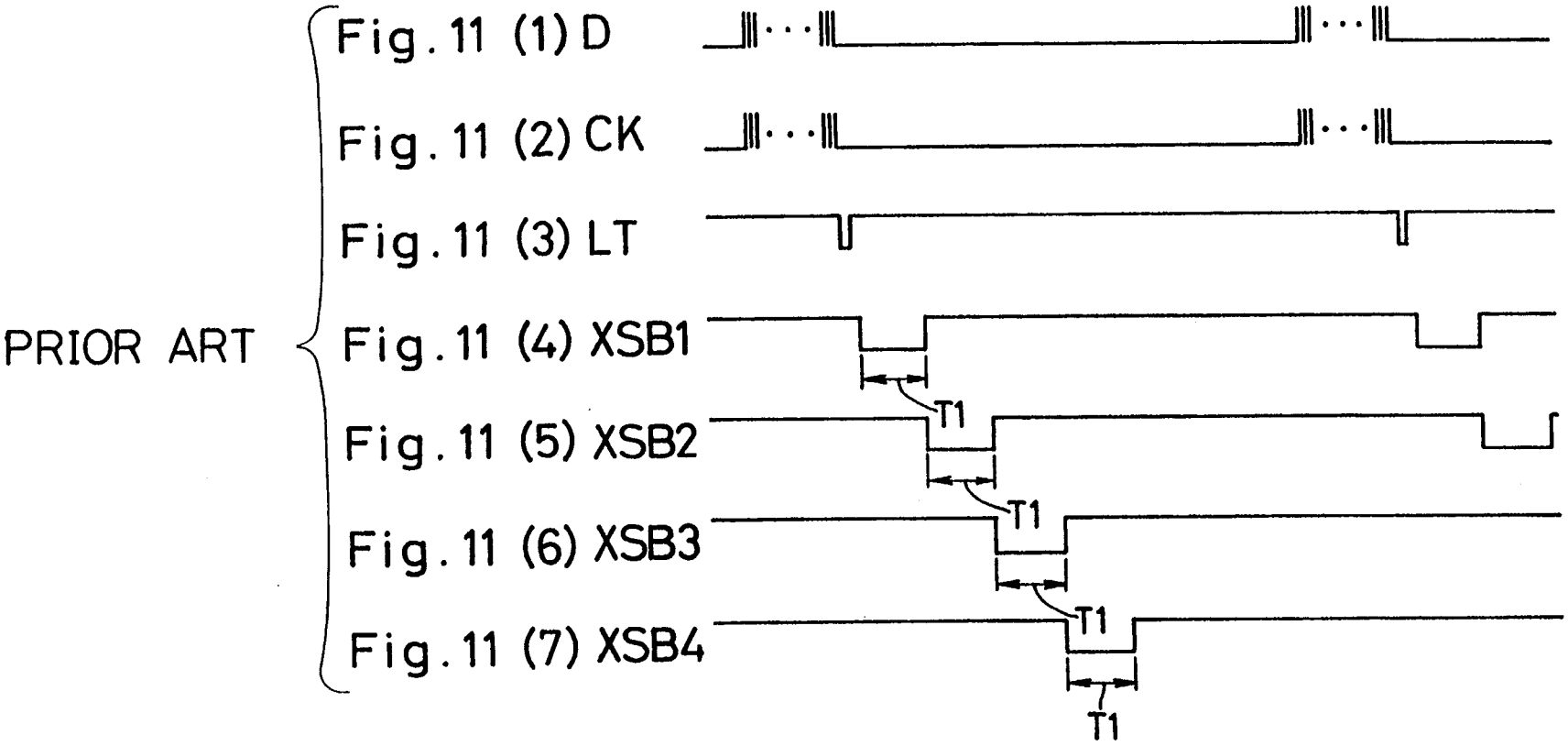
FIGS. 11(1)–11(7) are timing charts showing operation at high temperature of the thermal head 1 in FIG. 8.
Figure 12:
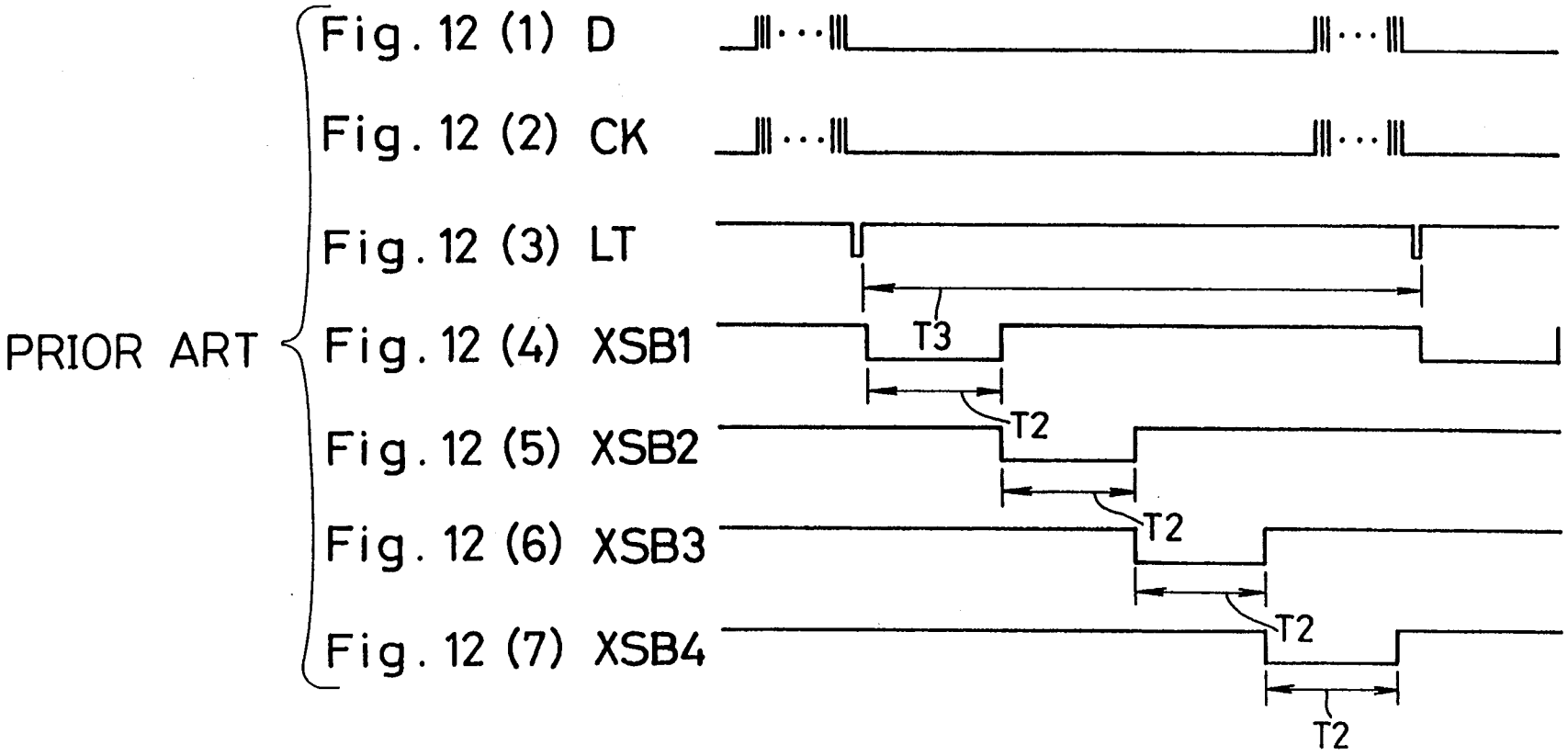
FIGS. 12(1)–12(7) are timing charts showing operation at low temperature of the thermal head 1 in FIG. 8.
Figure 13:
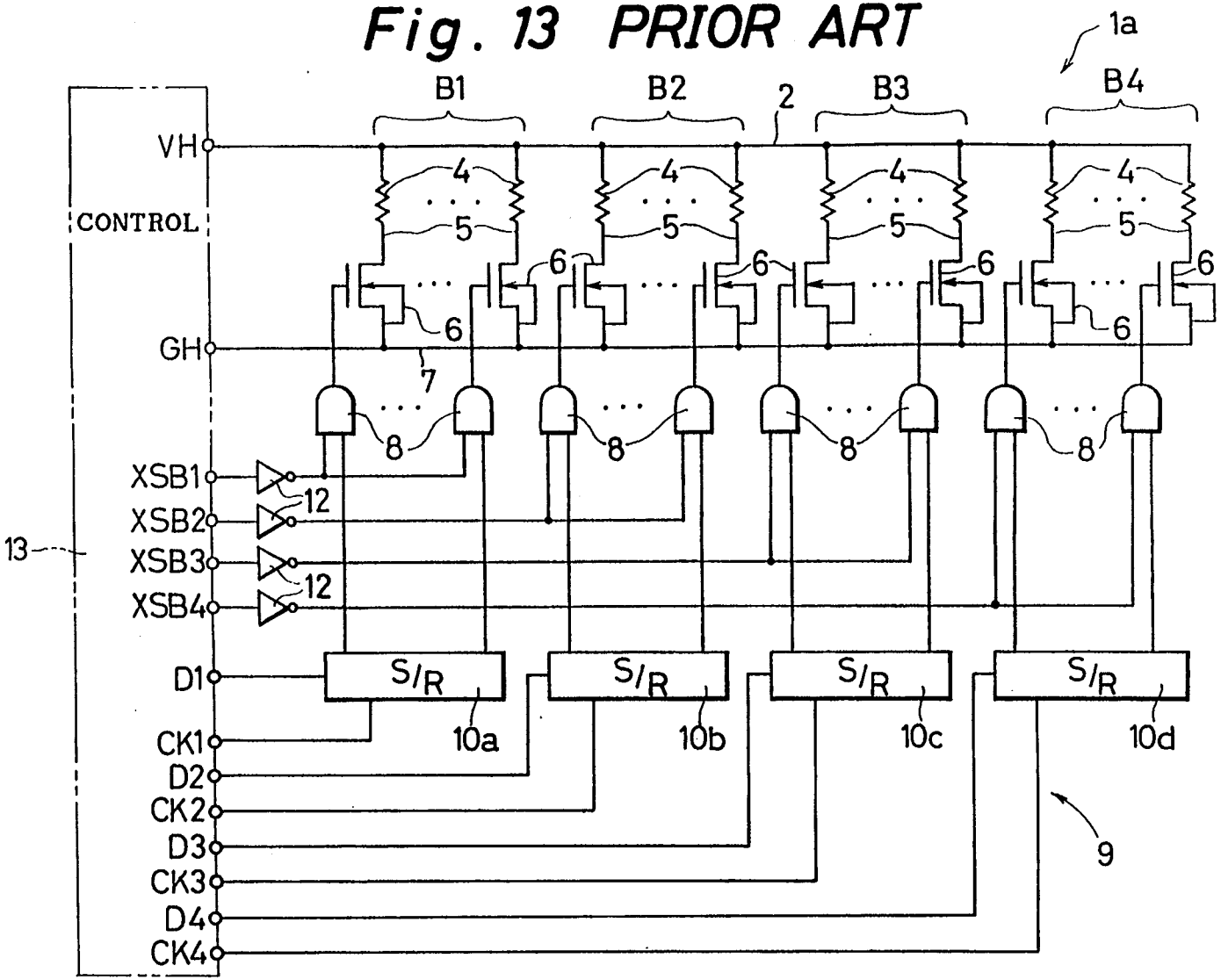
Fig. 13 PRIOR ART
FIG. 13 is an electric circuit diagram of a thermal head 1*a* in the second conventional example.

The printing region in the prior art and the embodiments is explained below. FIG. 5 is a schematic diagram showing the printing region on a recording medium in the first conventional example and second conventional example. As mentioned above, when printed in divisions by dividing into four blocks B1 to B4, in the first division line of the first line, the region corresponding to the block B1 is printed, and the other regions are not printed; in the second division line, the region corresponding to the block B2 is printed, and the other regions are not printed; in the third division line, the region corresponding to the block B3 is printed, and the other regions are not printed; and in the fourth division line, the region corresponding to the block B4 is printed, and the other regions are not printed. Thereafter, similarly in the second and subsequent lines, a printing region is formed continuously on diagonal lines of each region.

FIG. 6 is a schematic diagram showing the printing region on a recording medium in the embodiment shown in FIG. 1. As mentioned above, the two blocks B1 and B2 are further divided into the small blocks B1-1, B1-2, B2-1 and B2-2, and when printed by division as being disposed in every different block, in the first division line of the first line, the region corresponding to the small block B1-1 is printed, the region corresponding to the small block B2-2 is produced as no-print data, and the other regions are not printed. In the second division line, the region corresponding to the small block B2-1 is printed, and the region corresponding to the small block B2-2 is produced as no-print data, while the other regions are not printed. In the third division line, the region corresponding to the small block B1-2 is printed, and the region corresponding to the small block B1-1 is produced as no-print data, while the other regions are not printed. In the fourth division line, the region corresponding to the small block B2-2 is printed, and the region corresponding to the small block B2-1 is produced as no-print data, while the other regions are not reprinted. Hereinafter, similarly in the second and subsequent lines, the printing region is formed continuously on diagonal lines of each region.

Incidentally, the number of blocks of the heating resistive elements 24 in the invention is not limited to two, but any desired number may be selected.

FIG. 7 is a schematic diagram showing printing region on a recording medium when printed in the operation timing shown in FIG. 3. While the recording medium is conveyed at a constant speed, printing is done in time division in four periods, and therefore each line is further divided into four small lines. In the beginning small line, the printing region corresponding to the small block B1-1 is printed, while the other regions are not printed. Similarly, in the next small line, the small block B2-1 is printed, and the small block B1-2 in the next small line and the small block B2-2 in the final small line. Thereafter, in the second and subsequent lines, similar printing regions are formed.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A thermal head comprising:

plural heating elements, and a driving circuit element comprising plural switching elements connected individually to the heating elements, gate elements connected individually to the switching elements, and a shift register connected to the gate elements, wherein the plural heating elements are divided into plural blocks, and the gate elements of each block are connected to plural shift registers in the same number of bits as the number of heating elements of each block individually, strobe signals in the same number as the number of divisions of the block are fed into gate elements corresponding to each block, a clock gate element is provided in each block in order to obstruct clock input into the shift register corresponding to each block when printing of each block is active, and each block is further divided into plural small blocks, and the heating elements corresponding to each small block are disposed in every different block.

2. A method for driving a thermal head which comprises:

plural heating elements, and a driving circuit element comprising plural switching elements connected individually to the heating elements, gate elements connected individually to the switching elements, and a shift register connected to the gate elements, wherein the plural heating elements are divided into plural blocks, and the gate elements of each block are connected to plural shift registers in the same number of bits as the number of heating elements of each block individually, strobe signals in the same number as the number of divisions of the block are fed into gate elements corresponding to each block, a clock gate element is provided in each block in order to obstruct clock input into the shift register corresponding to each block when printing of each block is active, and each block is further divided into plural small blocks, and the heating elements corresponding to each small block are disposed in every different block, the method comprising the steps of:

feeding print data of one line portion continuously into each shift register, generating a clock in the period where the print data corresponding to each small block and print data to be of no printing are fed, and storing the print data corresponding to each small block into a predetermined shift register.

* * * * *